US007081856B2

(12) United States Patent
Minoura et al.

(10) Patent No.: US 7,081,856 B2
(45) Date of Patent: Jul. 25, 2006

(54) ANTENNA STRUCTURE

(75) Inventors: Yasuhiro Minoura, Gunma (JP); Seiji Go, Gunma (JP); Yoshito Noguchi, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 0 days.

(21) Appl. No.: 10/950,433

(22) Filed: Sep. 28, 2004

(65) Prior Publication Data

US 2005/0078040 A1 Apr. 14, 2005

(30) Foreign Application Priority Data

Sep. 29, 2003 (JP) ..... P2003-338499

(51) Int. Cl.
*H01Q 1/24* (2006.01)

(52) U.S. Cl. ..... 343/702; 343/872

(58) Field of Classification Search ..... 343/702, 343/872, 873, 906

See application file for complete search history.

(56) References Cited

U.S. PATENT DOCUMENTS

| | | | | |
|---|---|---|---|---|
| 5,341,149 | A | 8/1994 | Valimaa et al. | 343/895 |
| 6,292,156 | B1 * | 9/2001 | Openlander | 343/895 |
| 6,661,383 | B1 * | 12/2003 | Sakurai et al. | 343/702 |

FOREIGN PATENT DOCUMENTS

| | | |
|---|---|---|
| EP | 0 997 970 A1 | 5/2000 |
| EP | 1 143 557 A1 | 10/2001 |

* cited by examiner

*Primary Examiner*—Shih-Chao Chen
(74) *Attorney, Agent, or Firm*—Morgan Lewis & Bockius LLP

(57) ABSTRACT

A core member includes a cylindrical body. An antenna element is disposed on an outer peripheral face of the cylindrical body. A first engagement member is provided on the outer peripheral face of the cylindrical body. A cap member includes a peripheral wall fitted over the core member so as to cover the antenna element. A second engagement member is provided on an inner peripheral face of the peripheral wall to engage with the first engagement member. A restraining member is brought into contact with an outer peripheral face of the peripheral wall of the cap member to prevent the peripheral wall being deformed outward. The restraining member is opposed to at least a position where the second engagement member is provided.

8 Claims, 13 Drawing Sheets

PRIOR ART

PRIOR ART

ANTENNA STRUCTURE

BACKGROUND OF THE INVENTION

The present invention relates to an antenna structure comprising a core member provided with an antenna element, and a cap fixed to the core member so as to cover the antenna element.

In an antenna for a mobile phone or the like, an antenna element is provided on an outer peripheral face of a core member in a substantially cylindrical shape which is formed of insulating resin, and a cap formed of insulating resin is fitted around this antenna element to attain protection of the antenna element. Then, the cap is fixed to the core member.

A first example of a related-art antenna structure for fixing the cap to the core member will be described referring to FIG. 12.

A core member 10 formed of insulating resin or the like has, at its base end side, a tongue piece 10*a* for restraining an escape of the core member 10 when it has been inserted into a bore 12*a* in a casing body 12, and at its distal end side, an outer peripheral face 10*b* in a substantially cylindrical shape. An antenna element 14 is arranged on this outer peripheral face 10*b*. In addition, a ridge 10*c* is provided on an intermediate part in the outer peripheral face of the core member 10 so as to extend in a circumferential direction thereof, close to a position where the core member 10 is projected from the casing body 12. Further, a cap 16 formed of insulating resin or the like is fitted around the antenna element 14. This cap 16 is provided with a groove 16*a*, on its inner peripheral face adjacent to an opening end, so as to extend in a circumferential direction thereof. The cap 16 is forcibly press-fitted over the core member 10, and the ridge 10*c* is engaged with the groove 16*a*, thereby to fix the cap 16 to the core member 10.

Referring to FIG. 13, a second example of the related-art antenna structure for fixing the cap to the core member will be described. In this figure, same or equivalent members to those in FIG. 12 will be denoted with same reference numbers, and repetitive explanation will be omitted.

In this example, a male thread 10*d* is engraved on the outer peripheral face of the core member 10 in an intermediate part thereof, close to the position where the core member is projected from the casing body 12. On the other hand, a female thread 16*b* which is adapted to be screwed with the male thread 10*d* is engraved on the inner peripheral face of the cap 16 adjacent to the opening end thereof. The cap 16 is fitted over the core member 10, and the male thread 10*d* is tightly screwed with the female thread 16*b*, thereby to fix the cap 16 to the core member 10.

In either case of the related-art examples as shown in FIGS. 12 and 13, fixing and retaining force for the cap 16 depends on mechanical strength in a radial direction of the opening end of the cap 16 where the groove 16*a* or the female thread 16*b* is provided. This means that reducing a thickness of the cap 16 at the opening end may result in decrease of the retaining force. Therefore, under the present circumstances, an outer diameter d1 of the cap 16 at the opening end side is necessarily required to be larger than an outer diameter d2 of the cap 16 in the intermediate part and at the distal end side.

Because the outer diameter d1 of the cap 16 at the opening end side becomes large in the related-art examples, there is such an inconvenience that a mounting area of the antenna to the casing body 12 becomes large accordingly, and freeness of designing an outer appearance of the cap 16 is restricted. Moreover, in the first related-art example shown in FIG. 12, elasticity is required for the cap 16 to be press-fitted, and so, material for the cap 16 is limited to an elastomer of insulating resin. In the second related-art example shown in FIG. 13, a fixed position of the cap 16 in the circumferential direction of the core member 10 may be indefinite. This would be a drawback especially in a case where a logotype mark is put on the cap 16.

SUMMARY OF THE INVENTION

It is therefore an object of the invention to provide an antenna structure capable of reliably fixing a cap to a core member, without making an outer diameter of the cap in an opening end area thereof larger than that in other areas.

In order to achieve the above object, according to the invention, there is provided an antenna, comprising:

- a core member, comprising a cylindrical body;
- an antenna element, disposed on an outer peripheral face of the cylindrical body;
- a first engagement member, provided on the outer peripheral face of the cylindrical body;
- a cap member, comprising:
  - a peripheral wall fitted over the core member so as to cover the antenna element; and
  - a second engagement member provided on an inner peripheral face of the peripheral wall to engage with the first engagement member; and
- a restraining member, which is brought into contact with an outer peripheral face of the peripheral wall of the cap member to prevent the peripheral wall being deformed outward, the restraining member being opposed to at least a position where the second engagement member is provided.

With this configuration, since the deformation of the peripheral wall of the cap member is restrained by the restraining member, the disengagement of the second engagement member from the first engagement member can be prevented. Further, since it is unnecessary to retain the engagement between the core member and the cap member by the mechanical strength of the cap member itself, the outer diameter of the cap member need not be made larger.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

A first embodiment of the invention will be described below in detail with reference to FIGS. 1 to 4B.

A core member 20 is molded with insulative resin. A tongue piece 20*a* is formed at a base end side of the core member 20, which is to be fitted with a bore 22*a* of a casing body 22 for preventing the core member 20 from being slipped from the casing body 22. A pair of projections 20*c* are formed on an outer peripheral face of a cylindrical body 20*b* of the core member 20. The projections 20*c* are situated at opposite positions in the circumferential direction of the cylindrical body 20*b*. An antenna element 14 is disposed on the outer peripheral face of the cylindrical body 20*b*. Although it is not shown, one end of the antenna element 14 is electrically connected to a circuitry provided in the casing body 22 as an antenna output terminal.

A cap 24 is molded with insulative resin so as to have a cylindrical shape in which an outer diameter is made uniform entirely in the longitudinal direction thereof. A pair of holes 24*a* are formed in the vicinity of an opening end of the cap 24. The holes 24*a* are situated at opposite positions in the circumferential direction of the cap 24.

Figure 1:
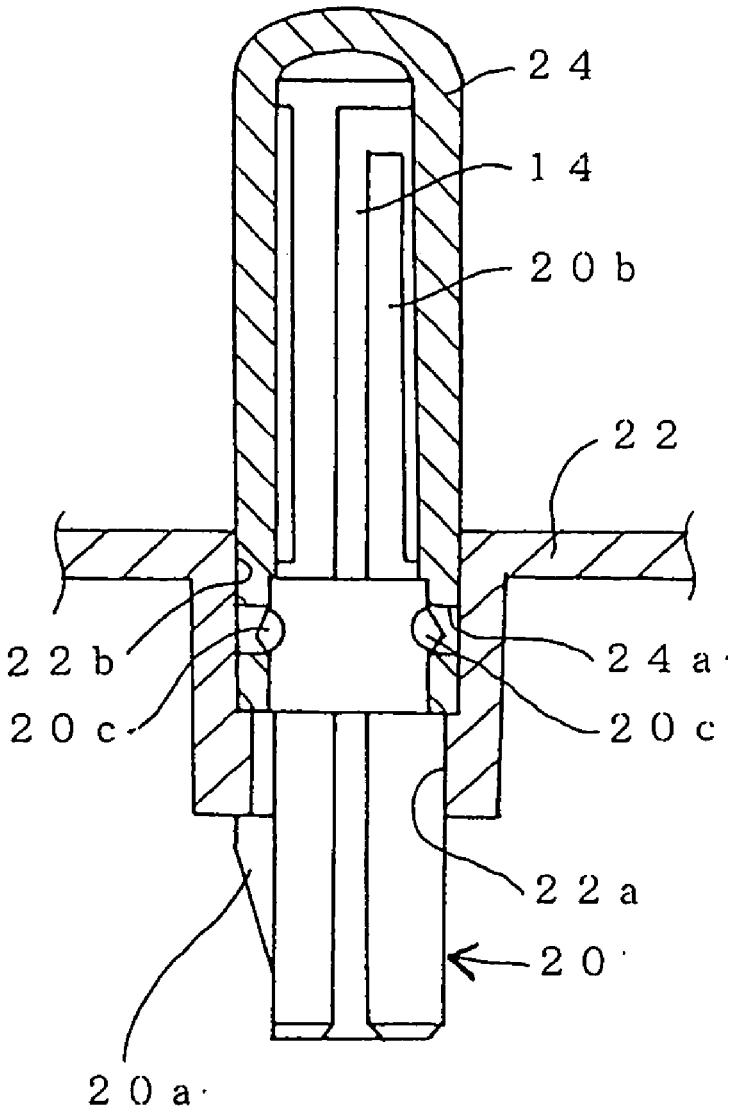
FIG. 1 is a vertical sectional view of an antenna structure according to a first embodiment of the invention.
Figures 2A, 2B, 2C:
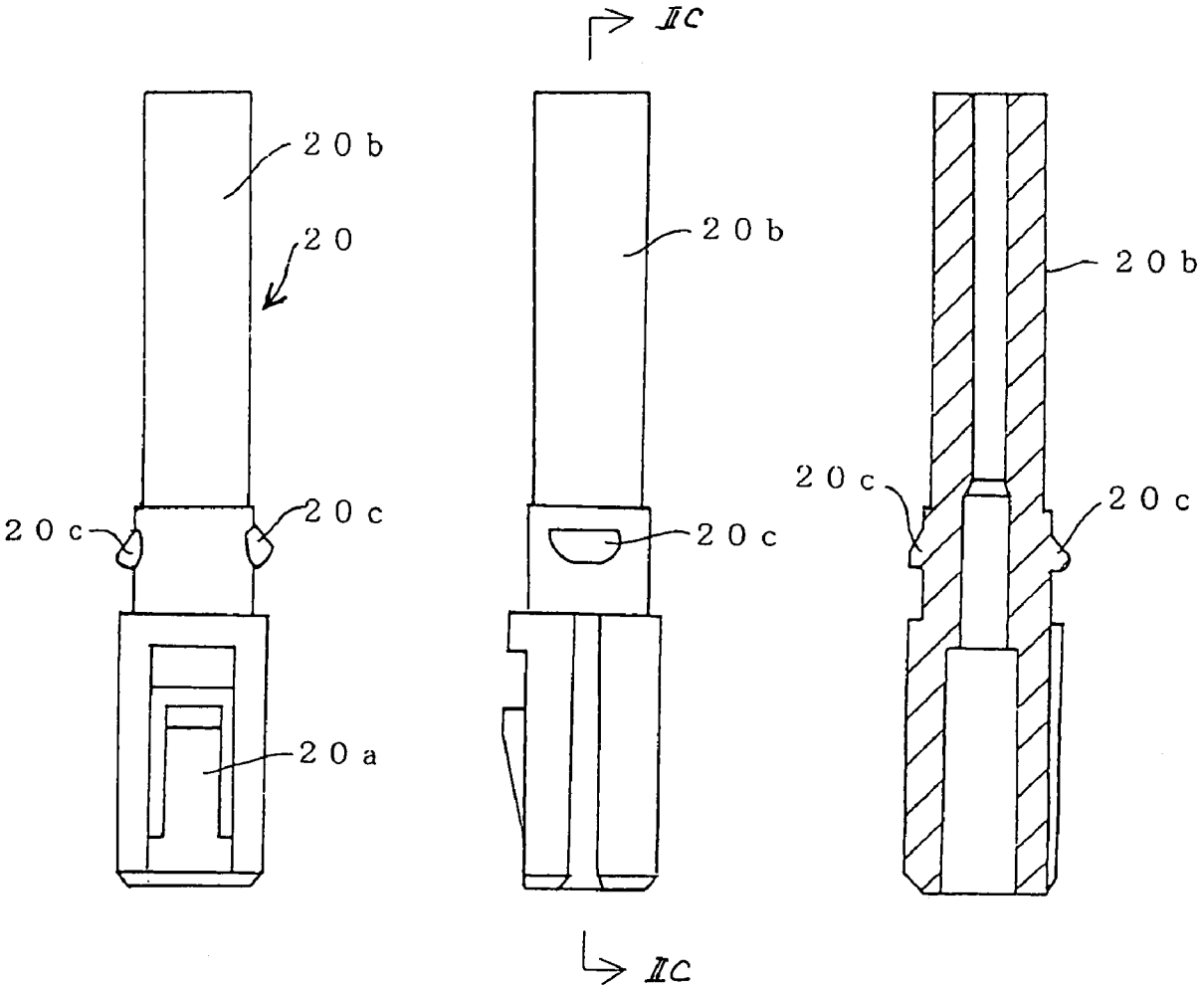
FIG. 2A is a front view of a core member in the antenna structure of FIG. 1.
FIG. 2B is a side view of the core member of FIG. 2A.
FIG. 2C is a vertical section view taken along a line IIC—IIC in FIG. 2B.
Figure 3C:
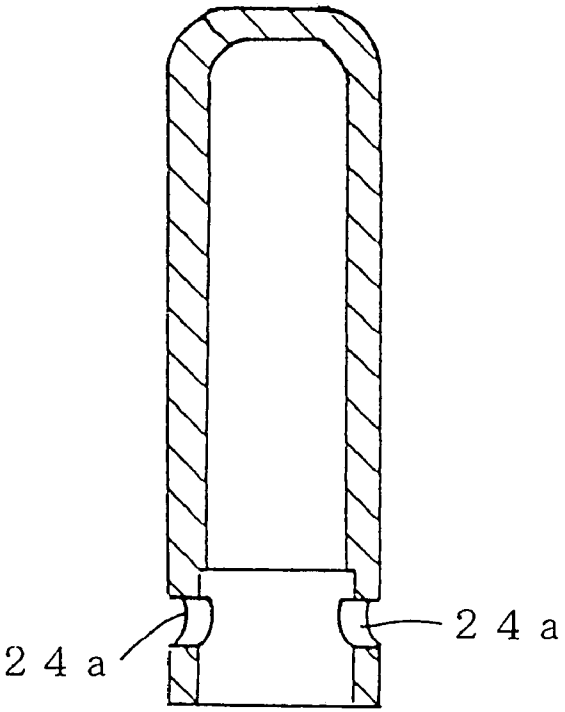
FIG. 3C is a vertical section view taken along a line IIIC—IIIC in FIG. 3B.
Figure 3B:
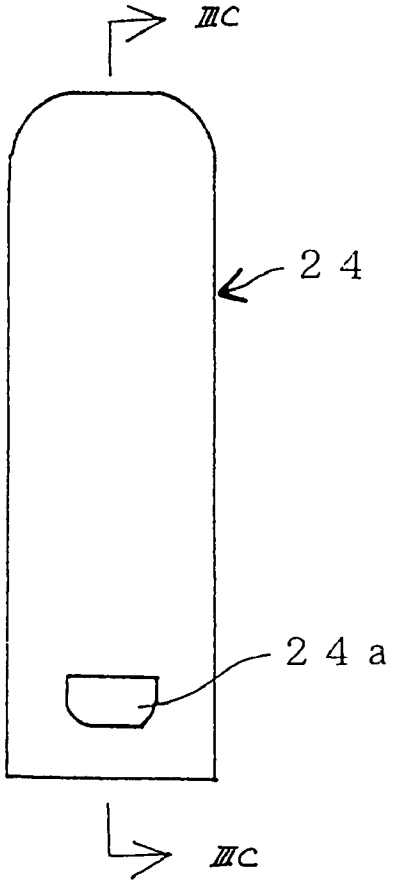
FIG. 3B is a side view of the cap of FIG. 2A.
Figure 3A:
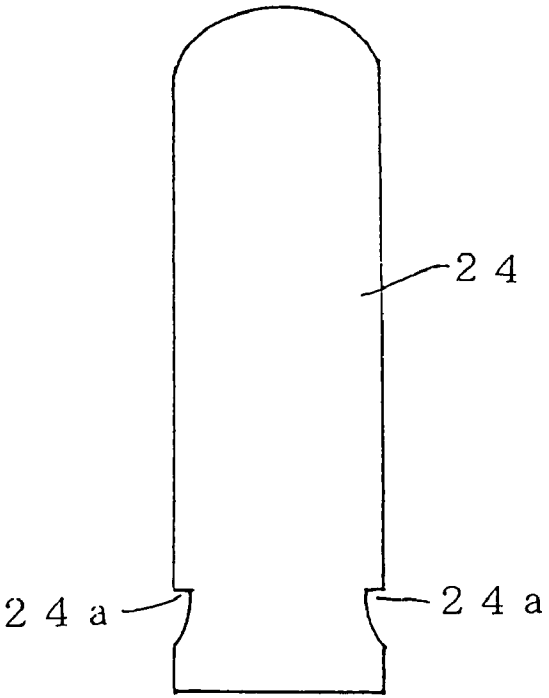
FIG. 3A is a front view of a cap in the antenna structure of FIG. 1.
Figure 4B:
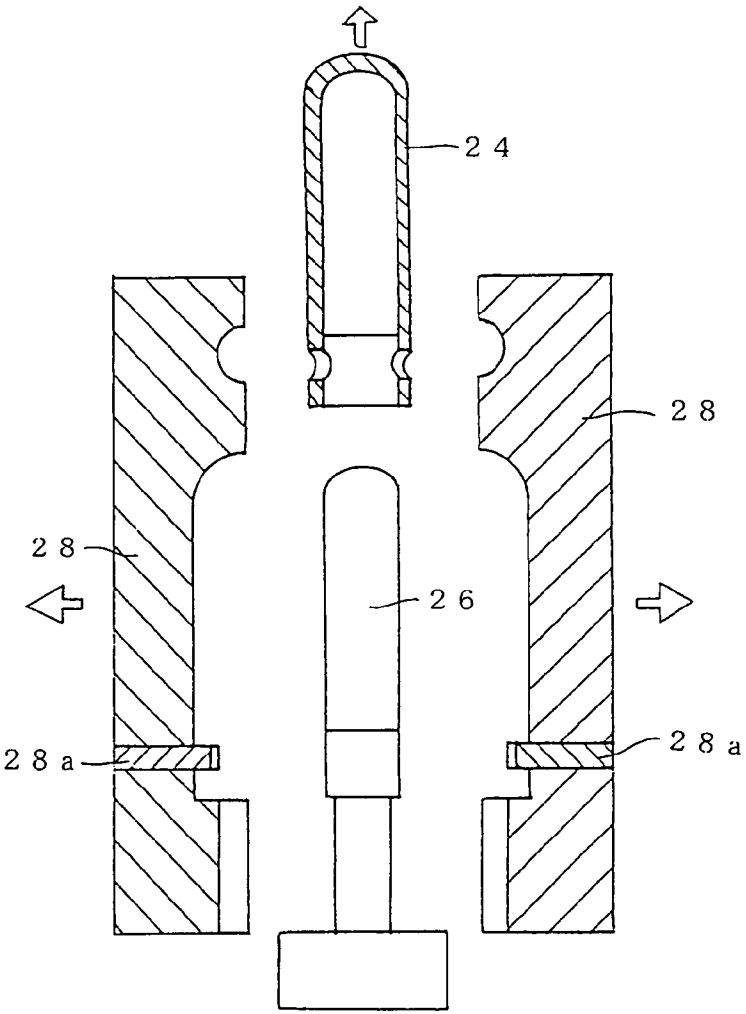
FIG. 4B is a section view of the dies of FIG. 4A, showing a state after the cap is molded.
Figure 4A:
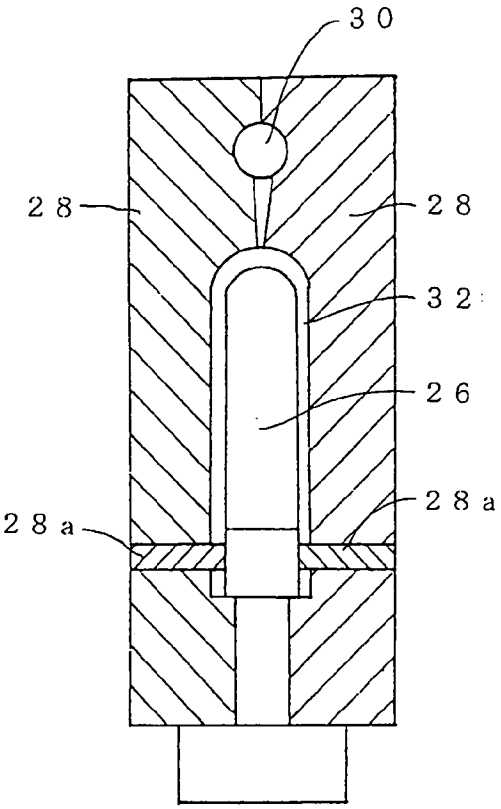
FIG. 4A is a section view of dies for molding the cap, showing a state before the cap is molded.

In order to form the cap 24, as shown in FIG. 4A, a pair of outer dies 28 are prepared. The dies 28 are provided with members 28*a* for forming the holes 24*a*. A core die 26 is disposed within a cavity 32 defined by the dies 28. Molten resin is injected into the cavity 32 via a gate 30 to form the cap 24. After than, as shown in FIG. 4B, the outer dies 28 are laterally moved to open the cavity 32. In this condition, the molded cap 24 can be easily separated upward from the core die 26.

The casing body 22 is provided with a restraining bore 22*b* which is continued from the bore 22*a*. The restraining bore 22*b* has a diameter which is slightly larger than the diameter of the bore 22*a* and the outer diameter of the opening end of the cap 24.

The cap 24 is fitted over the core member 20 to cover the antenna element 14, such that the projections 20*c* are fitted into the holes 24*a*. Next, the base end of the core member 20 is inserted into the bore 22*a* of the casing body 22, so that the opening end of the cap 24 is inserted into the restraining bore 22*b*. The tongue piece 20*a* which has been elastically deformed upon the passage through the bore 22*a* is restored to engage with the casing body 22 to prevent the core member 20 from slipping off. The inner face of the restraining bore 22*b* prevents the opening end side of the cap 24 from deforming outward.

Figure 12:
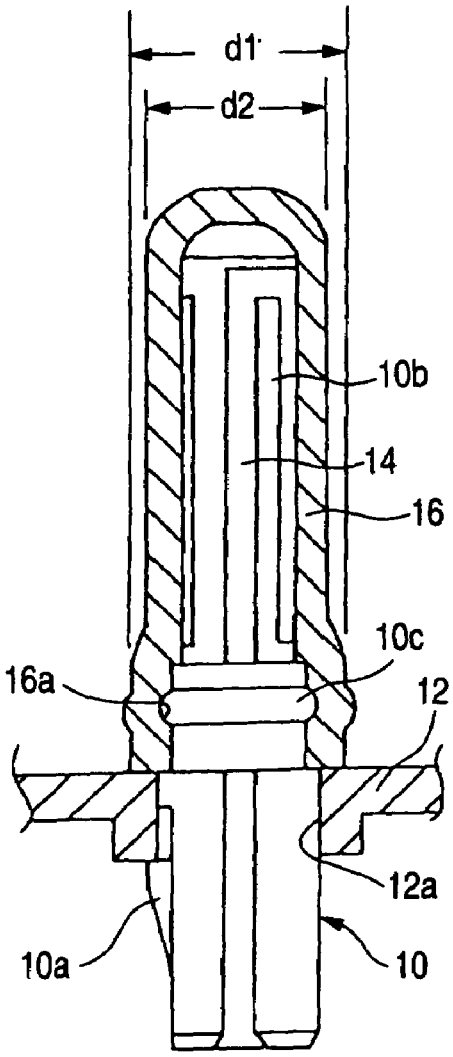
FIG. 12 is a vertical sectional view of a first example of a related-art antenna structure.
Figure 13:
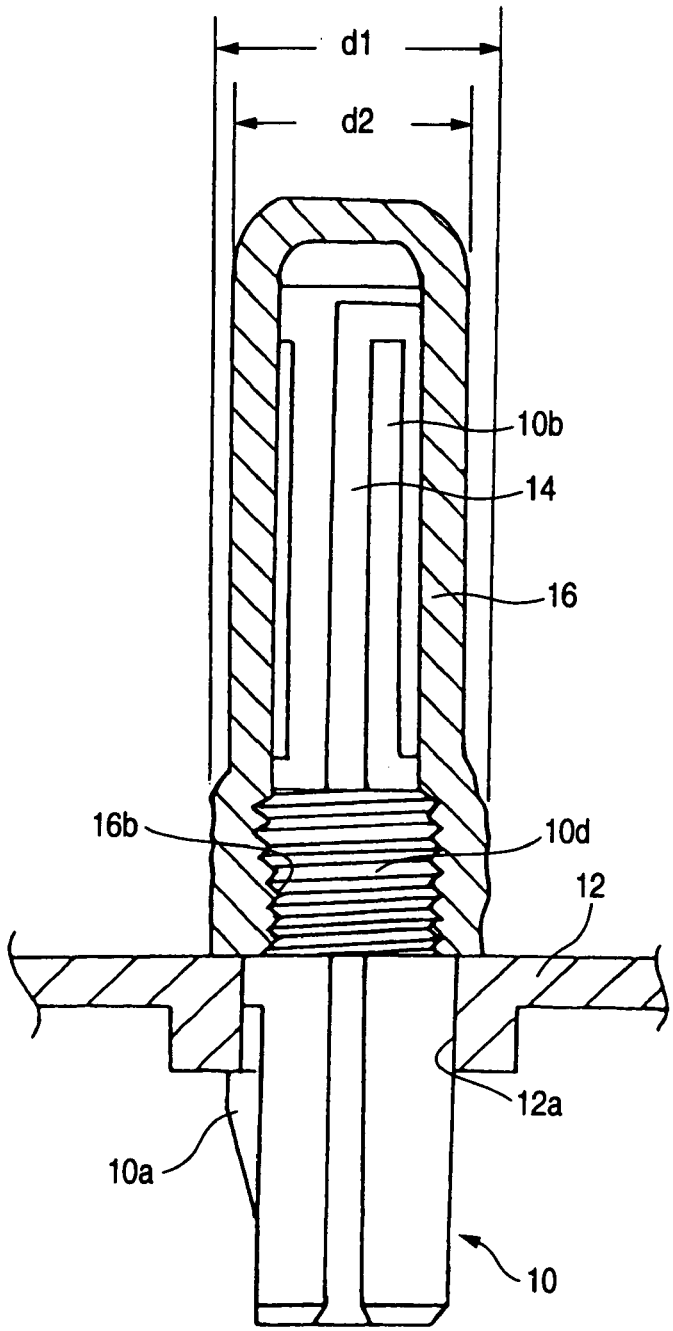
FIG. 13 is a vertical sectional view of a second example of the related-art antenna structure.

With this structure, the outer diameter of the cap 24 at the opening end will not become larger than that of the intermediate part and the distal end side. Accordingly, the mounting area of the antenna on the casing body 22 can be made smaller. Moreover, there will be less restriction in designing the outer appearance. Further, it would be sufficient that the cap 24 is slightly press-fitted to the core member 20, and as the material of the cap 24, polycarbonate and ABS resins may be also employed, but not limited to an elastomer. Additionally, because the opening end of the cap 24 is inserted into the restraining bore 22*b*, a length of the cap 24 protruding from the casing body 22 can be reduced. Hence, provided that the length protruding from the casing body is the same as that of the related-art antenna structure as shown in FIGS. 12 and 13, the length of the antenna element 14 in a protruding direction can be made longer, and receiving sensitivity can be enhanced accordingly.

Figure 5:
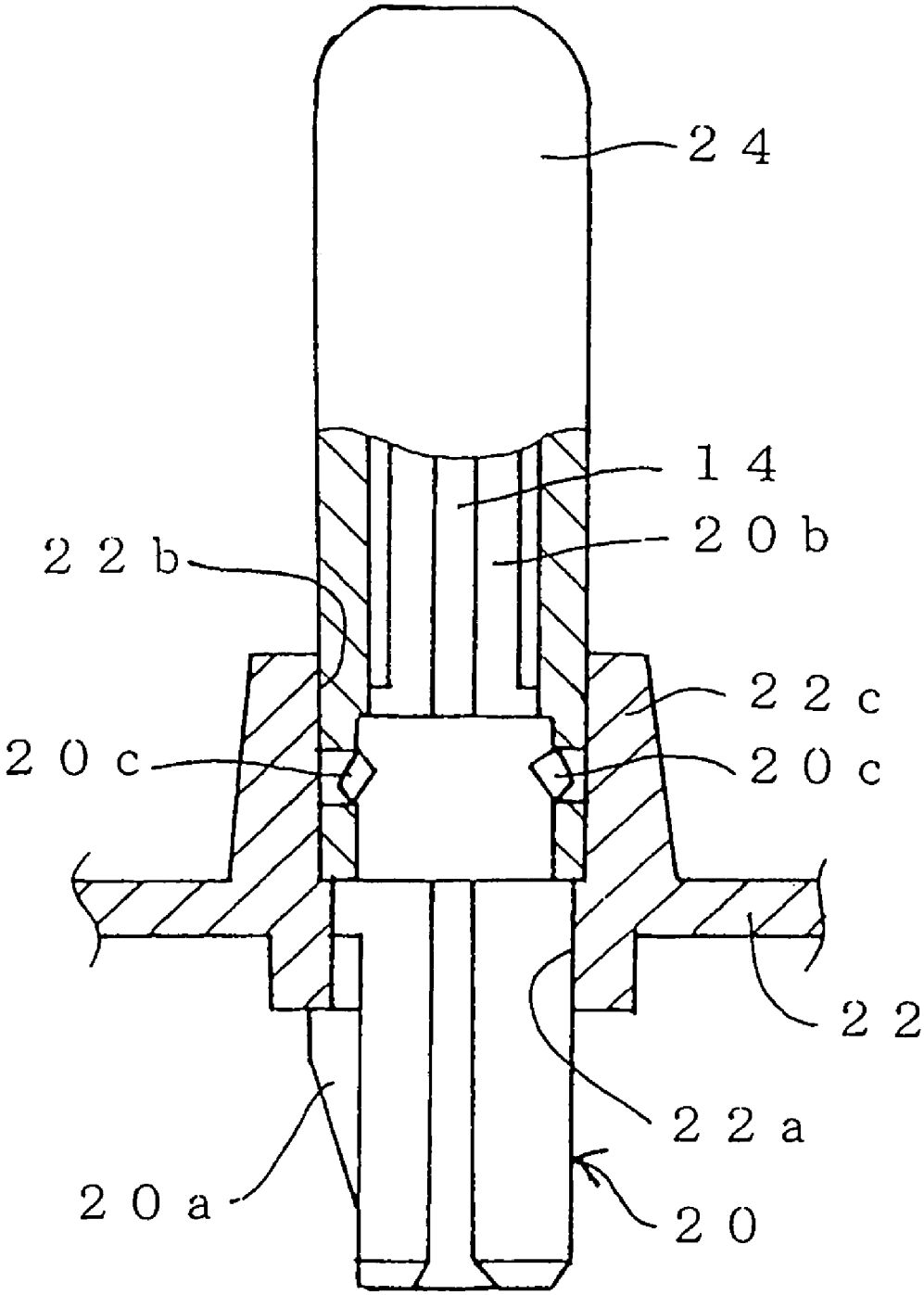
FIG. 5 is a vertical section view of a first modified example of the antenna structure of FIG. 1.

FIG. 5 shows a first modified example of the antenna structure in the first embodiment. In this case, the casing body 22 is provided with a mount 22*c* which is projected outwardly to form the restraining bore 22*b*.

Figure 6A:
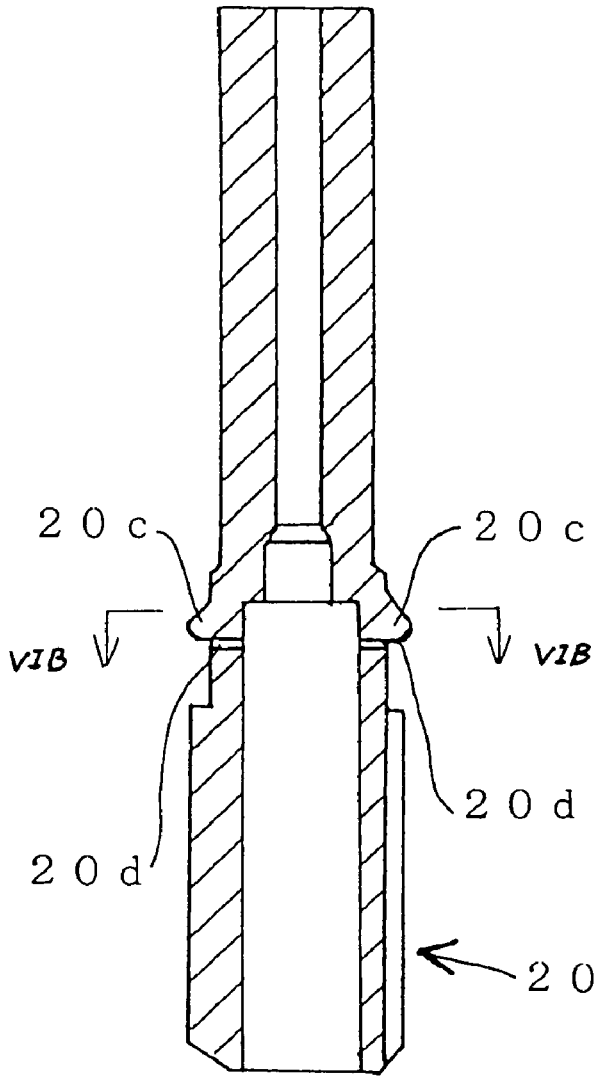
FIG. 6A is a vertical section view of a second modified example of the antenna structure of FIG. 1.
Figure 6B:
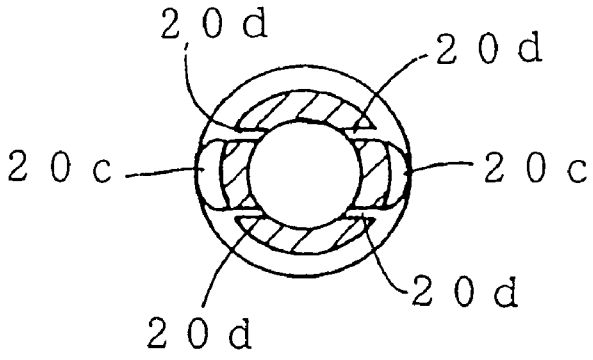
FIG. 6B is a lateral section view taken along a line VIB—VIB in FIG. 6A.

FIGS. 6A and 6B show a second modified example of the antenna structure in the first embodiment. In this case, slits 20*d* are formed in the cylindrical body 20*b* of the core member 20 such that the distal-side ends of the projections 20*c* are supported on the cylindrical body 20*b* in a cantilevered manner. Since the cantilevered projections 20*c* are deformed inward when the cap 24 is fitted over the core member 20, less or no elasticity is required for the cap 24. Therefore, selection of the material can be made free, which is preferable for making the outer diameter of the cap 24 smaller.

Figure 7:
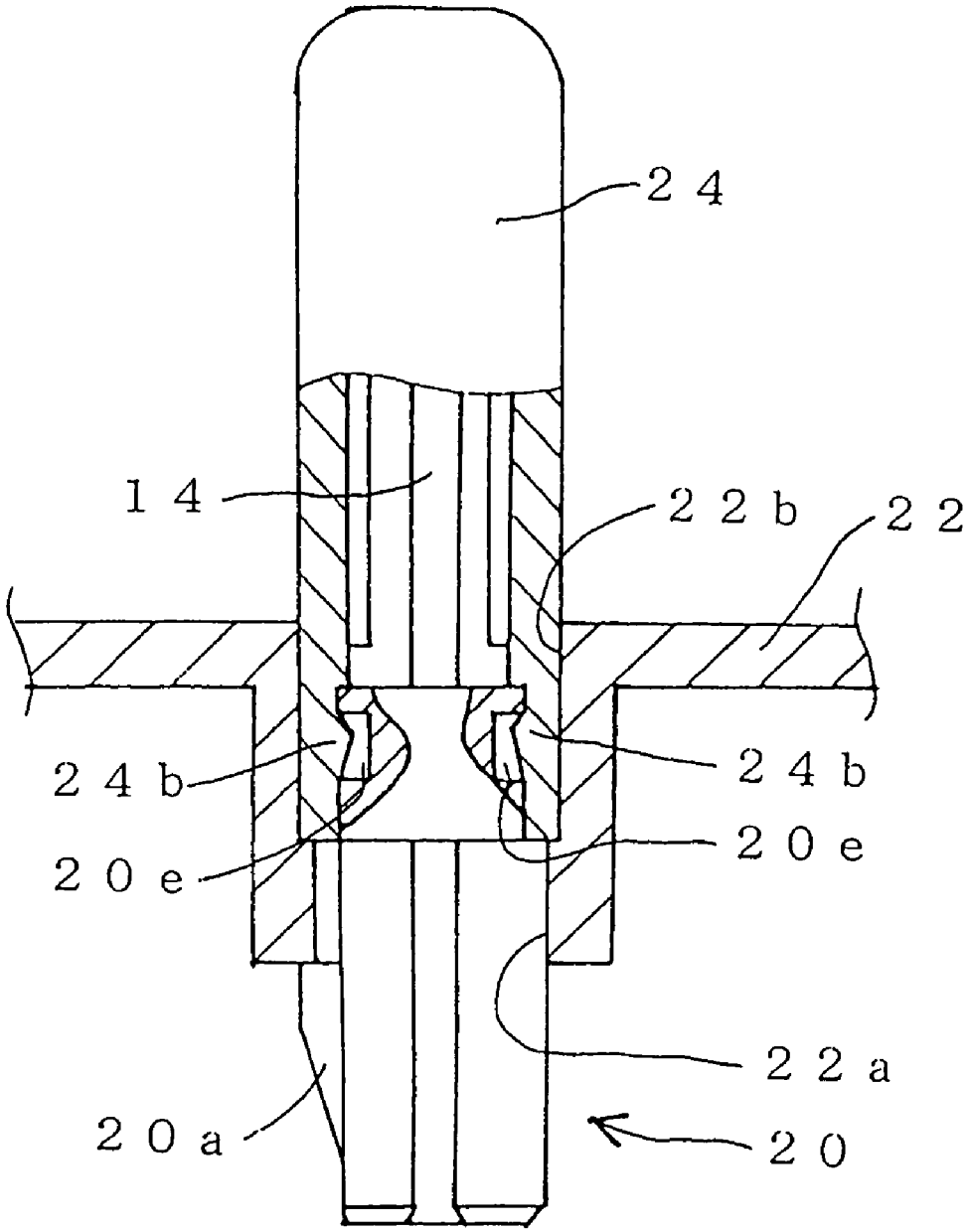
FIG. 7 is a vertical section view of a third modified example of the antenna structure of FIG. 1.

FIG. 7 shows a third modified example of the antenna structure in the first embodiment. In this case, the outer peripheral surface of the cylindrical body 20*b* is formed with recesses 20*e* at opposite positions in the circumferential direction thereof. On the other hand, the inner peripheral face of the cap 24 is provided with projections 24*b*. When the cap 24 is fitted over the core member 20, the projections 24*b* are fitted into the recesses 20*e*.

Also in this case, the restraining bore 22*b* prevents the opening end of the cap 24 from being deformed outward, thereby preventing the disengagement of the cap 24 from the core member 20.

Figure 8:
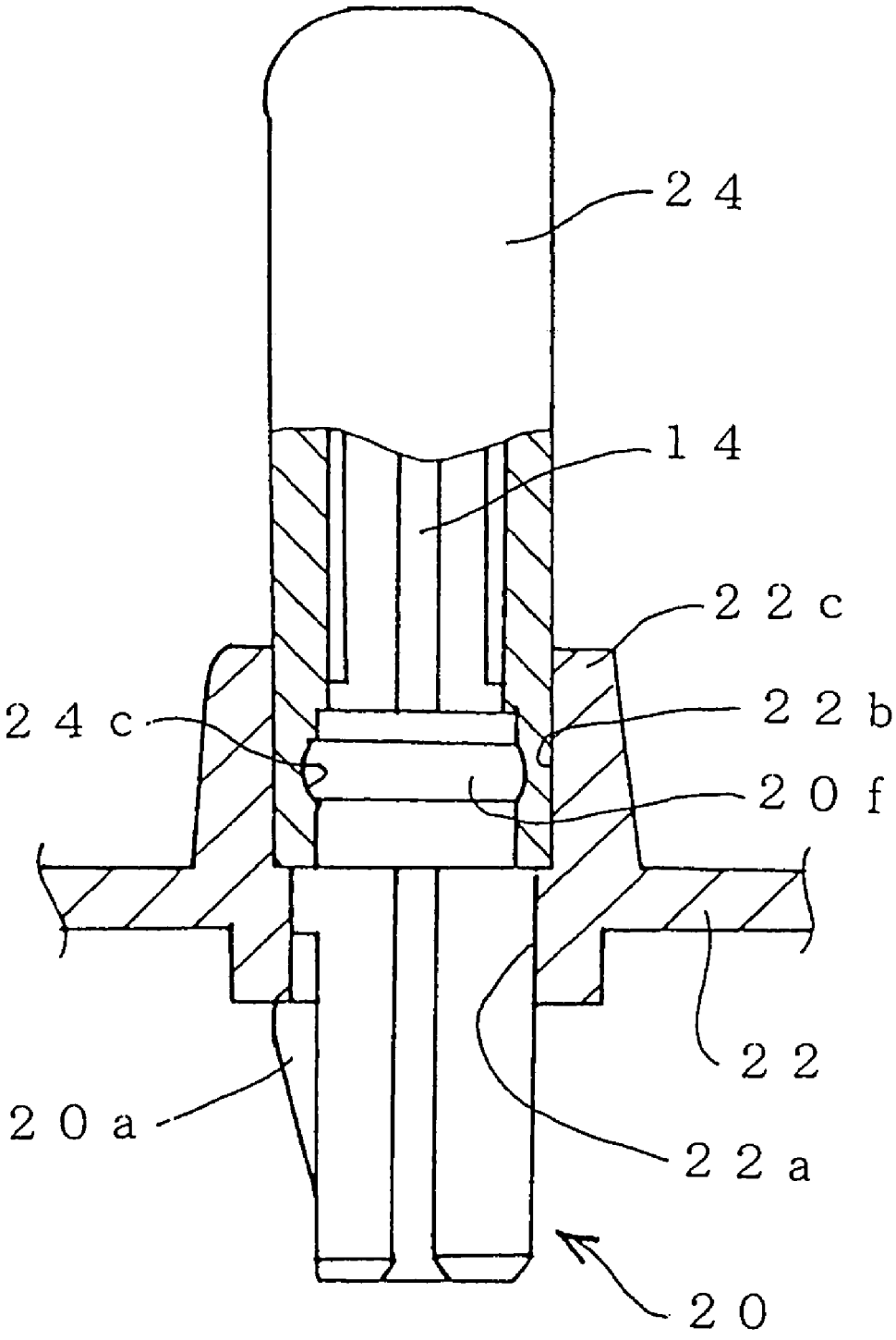
FIG. 8 is a vertical sectional view of an antenna structure according to a second embodiment of the invention.

Next, a second embodiment of the invention will be described with reference to FIG. 8. The similar components will be designated by the same reference numerals and the repetitive explanations will be omitted. In this embodiment, a protrusion 20*f* is formed on the outer peripheral face of the cylindrical body 20*b* entirely in the circumferential direction thereof. On the other hand, a groove 24*c* is formed on the inner peripheral face of the cap 24 entirely in the circumferential direction. Although the opening end of the cap 24 is elastically deformed outwardly on occasion of press-fitting the cap 24 to the core member 20, the elastic deformation at the opening end of the cap 24 is restrained by the restraining bore 22*b*, after the cap 24 has been inserted into the casing body 22. Accordingly, the engagement will not be released.

Figure 9:
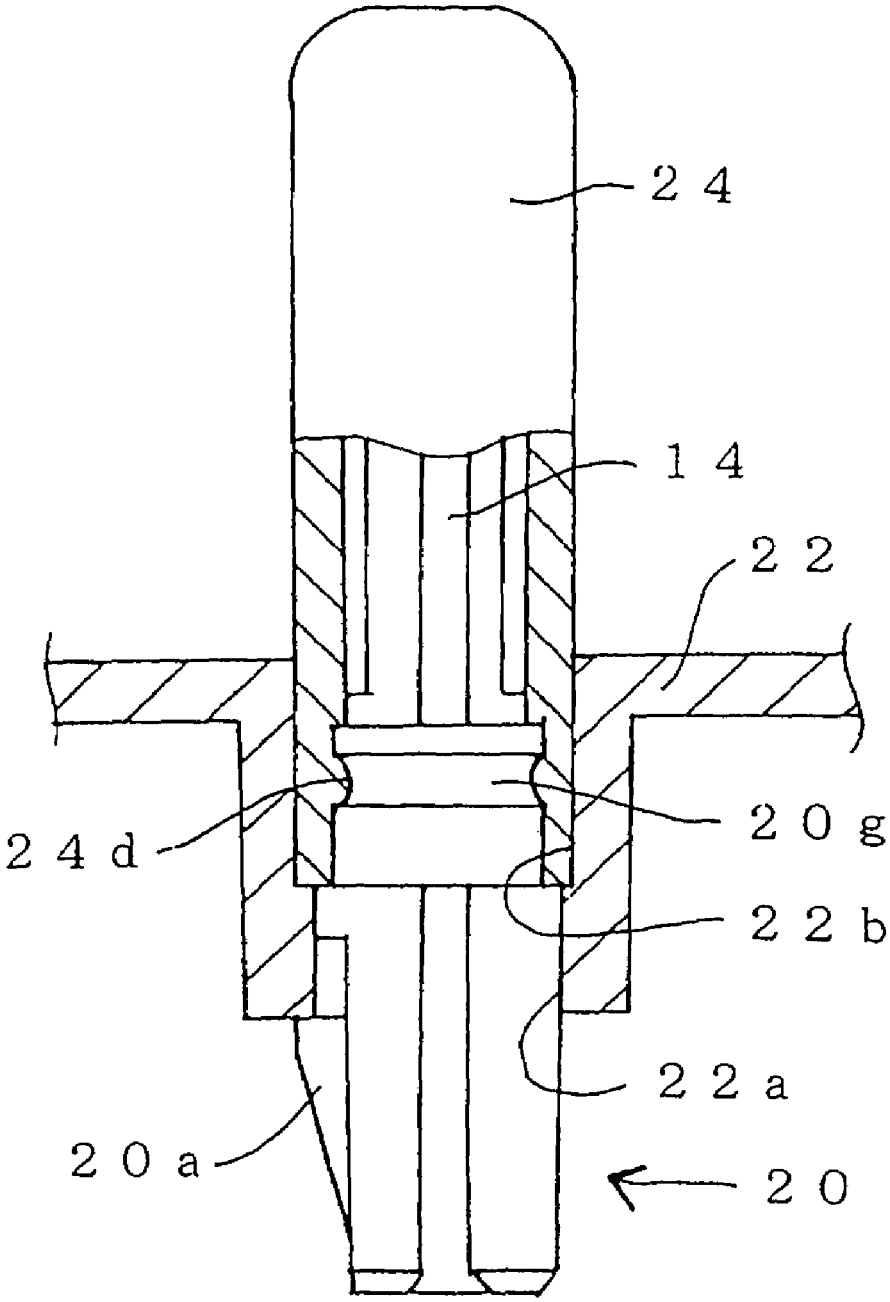
FIG. 9 is a vertical section view of a modified example of the antenna structure of FIG. 8.

FIG. 9 shows a modified example of the antenna structure in the second embodiment. In this case, a groove 20*g* is formed on the outer peripheral face of the core member 20 entirely in the circumferential direction thereof, while a protrusion 24*d* is formed on the inner peripheral face of the cap 24 entirely in the circumferential direction.

Figure 10:
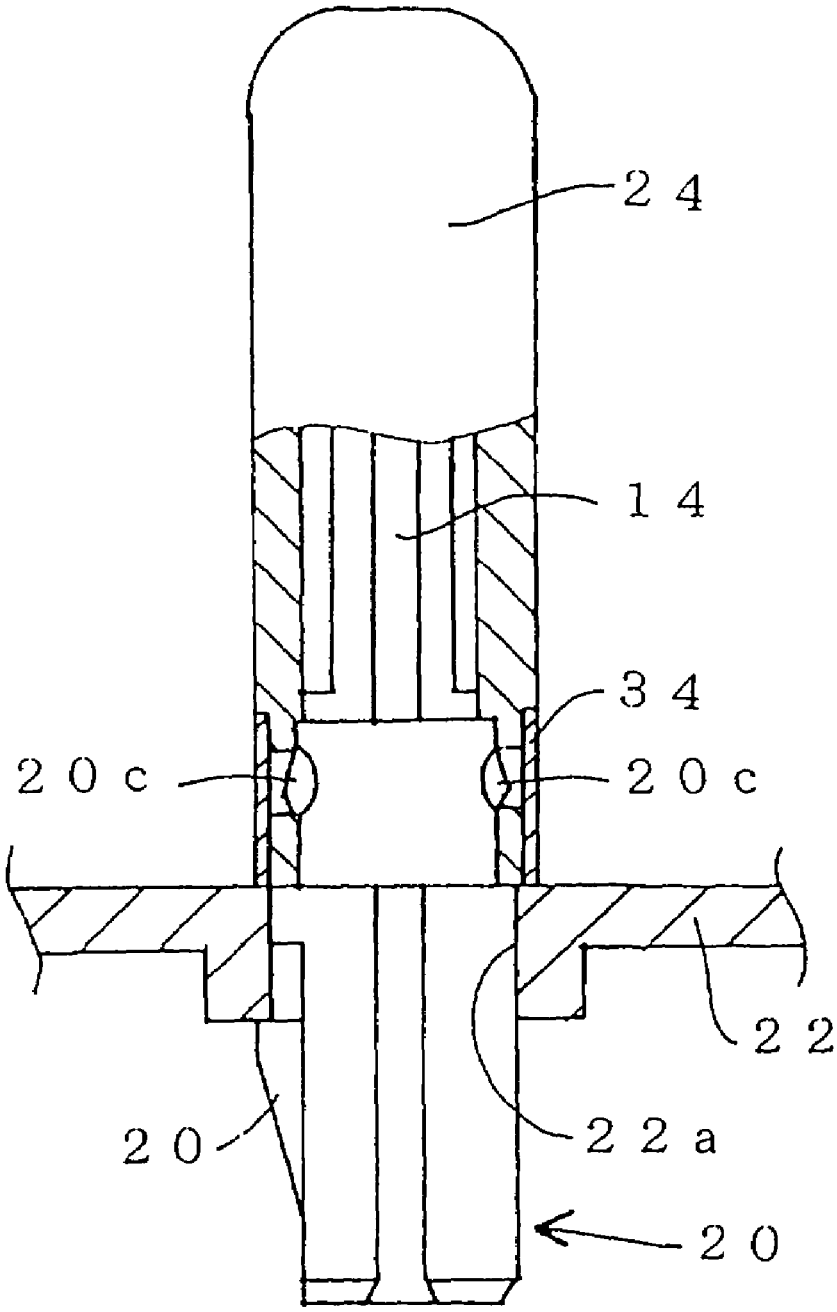
FIG. 10 is a vertical sectional view of an antenna structure according to a third embodiment of the invention.

Next, a third embodiment of the invention will be described with reference to FIG. 10. This embodiment is different from the antenna structure in the first embodiment, in that an annular member 34 having no elastically is arranged on the outer peripheral face of the cap 24 at the opening end thereof, instead of restraining the outward deformation of the outer peripheral face of the cap 24 at the opening end by the casing body 22. The annular member 34 may be engaged in a state where the cap 24 has been fitted to the core member 20, or the annular member 34 may be appropriately tightened to be secured. The opening end of the cap 24 will be unable to be deformed outwardly by the annular member 34, and the engagement will not be released. Apparently, the casing body 22 need not be provided with the restraining bore 22*b*.

Figure 11A:
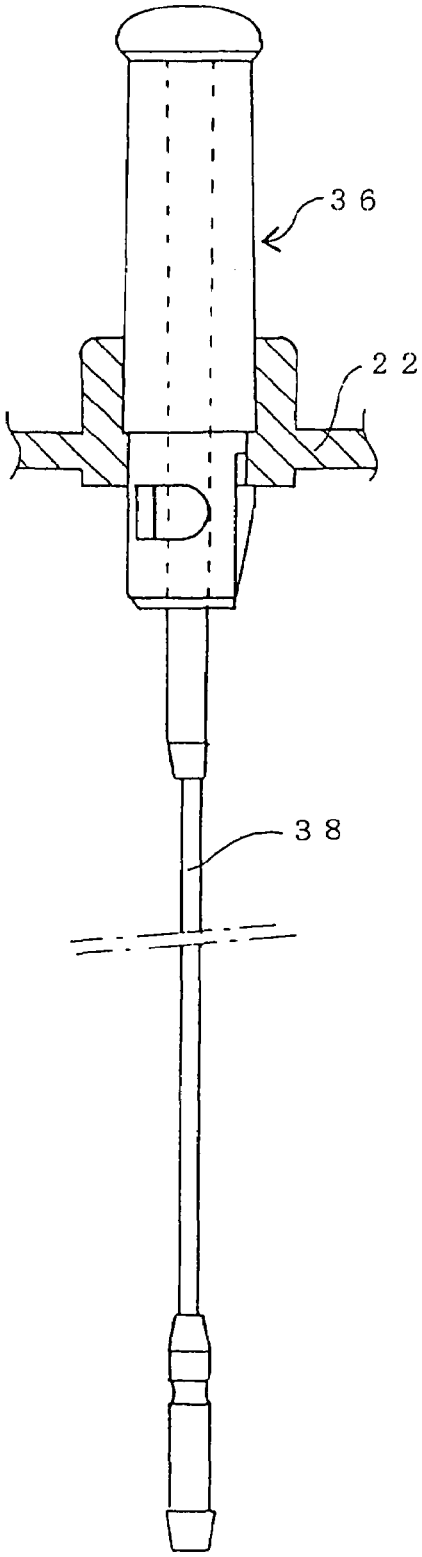
FIG. 11A is a partial sectional view of an antenna structure according to a fourth embodiment of the invention, showing a state that an antenna rod is contained in a casing body.
Figure 11B:
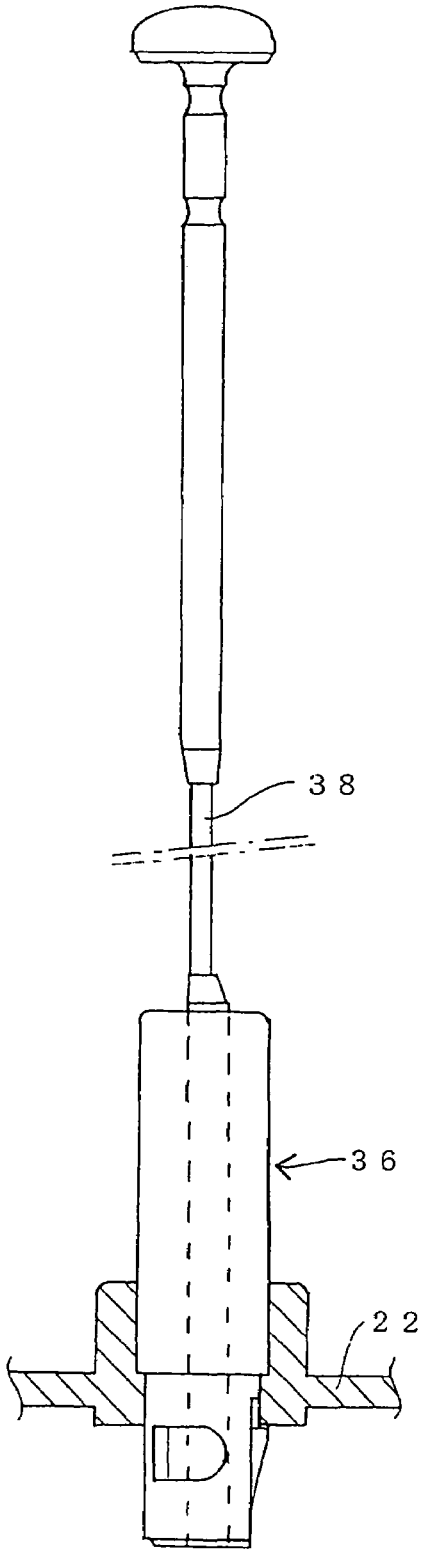
FIG. 11B is a partial sectional view of the antenna structure of FIG. 11A, showing a state that the antenna rod is pulled out from the casing body.

All the antenna structures in the above described embodiments are of such a type that the antenna structure is fixed to the casing body 22 in a state protruded outwardly (so-called STUB type). However, as a fourth embodiment shown in FIG. 11, the antenna structure may be constructed in a so-called bottom loading type, by arranging an antenna rod 38 at a position of a center axis of an antenna structure 36 so as to be retractably extended from the casing body 22. In this case, the core member 20 may be formed in a tubular shape into which the antenna 38 can be inserted, although a specific structure is not shown in the drawing. In order to make this antenna rod 38 extendable and retractable, a known technique of this type can be employed.

It is to be noted that the structure of the antenna element 14 in the above described embodiments may be in any shape, being not only in a meander shape, as shown in the drawings, but also in a coil shape. Moreover, the structure for retaining the core member 20 on the casing body 22 may be in any type, including not only the tongue piece 20*a* as in the above embodiments, but also a male thread formed in the base end part of the core member 20 to be screwed with a female thread formed in the casing body 22.

What is claimed is:

1. An antenna, comprising:

a core member, comprising a cylindrical body;

an antenna element, disposed on an outer peripheral face of the cylindrical body;

a first engagement member, provided on the outer peripheral face of the cylindrical body;

a cap member, comprising:

a peripheral wall fitted over the core member so as to cover the antenna element; and a second engagement member provided on an inner peripheral face of the peripheral wall to engage with the first engagement member; and a restraining member, which is brought into contact with an outer peripheral face of the peripheral wall of the cap member to prevent the peripheral wall being deformed outward, the restraining member being opposed to at least a position where the second engagement member is provided.

2. The antenna as set forth in claim 1, wherein the restraining member is a part of a casing body to which the core member is secured.

3. The antenna as set forth in claim 1, wherein the restraining member is an annular member having a less elasticity than the cap member.

4. The antenna as set forth in claim 1, wherein the first engagement member is a projection, and the second engagement member is a hole into which the projection is fitted.

5. The antenna as set forth in claim 1, wherein the first engagement member is a protrusion entirely extending in a circumferential direction of the cylindrical body, and the second engagement member is a groove into which the protrusion is fitted.

6. The antenna as set forth in claim 4, wherein the projection is provided on a free end portion of a cantilevered piece supported on the outer peripheral face of the cylindrical body.

7. The antenna as set forth in claim 1, wherein the second engagement member is a projection, and the first engagement member is a hole into which the projection is fitted.

8. The antenna as set forth in claim 1, wherein the second engagement member is a protrusion entirely extending in a circumferential direction of an inner peripheral face of the cap member, and the first engagement member is a groove into which the protrusion is fitted.

* * * * *